US005465852A

United States Patent [19]

Koks et al.

[11] Patent Number: 5,465,852

[45] Date of Patent: Nov. 14, 1995

[54] DISPLAY FRAME FOR SMALL ARTICLES

[75] Inventors: Maarten Koks, Prinsenbeck, Netherlands; Franz Titulaer, Holmenvn 15, Lier N-3400, Norway

[73] Assignees: Franz Titulaer, Holmenvn; Birgit Loitegaard, Lier, both of Norway

[21] Appl. No.: 162,032

[22] PCT Filed: Apr. 2, 1993

[86] PCT No.: PCT.NO93/00053

§ 371 Date: Dec. 1, 1993

§ 102(e) Date: Dec. 1, 1993

[87] PCT Pub. No.: WO93/19652

PCT Pub. Date: Oct. 14, 1993

[30] Foreign Application Priority Data

Apr. 2, 1992 [NO] Norway ..... 921289

[51] Int. Cl.[6] ..... A47B 47/00

[52] U.S. Cl. ..... 211/87; 211/94

[58] Field of Search ..... 211/87, 94, 162; 312/204, 114, 265.2, 265.3, 265.6

[56] References Cited

U.S. PATENT DOCUMENTS

| | | | |
|---|---|---|---|
| 4,106,229 | 8/1978 | Schmid | 40/611 |
| 4,128,995 | 12/1978 | Marra et al. | 40/489 |
| 4,155,457 | 5/1979 | Wilbert | 211/4 |
| 4,460,097 | 7/1984 | Darnell, II et al. | 211/189 |
| 4,488,463 | 5/1984 | Amos | 312/111 |
| 4,629,076 | 12/1986 | Amstutz et al. | 211/94 |
| 4,790,609 | 12/1988 | Guy | 312/117 |
| 4,981,226 | 1/1991 | Shallenberg et al. | 211/189 |
| 5,078,284 | 1/1992 | Pirkl et al. | 211/198 |

FOREIGN PATENT DOCUMENTS

| | | |
|---|---|---|
| WO90/05354 | 5/1990 | WIPO . |
| WO93/00846 | 1/1993 | WIPO . |

*Primary Examiner*—Leslie A. Braun
*Assistant Examiner*—Catherine S. Collins
*Attorney, Agent, or Firm*—Tilton, Fallon, Lungmus & Chestnut

[57] ABSTRACT

A display frame for the display of small articles, such as jewelry, having an interchangeable rear wall, the display frame comprising a frame which includes two parallel side walls and top and bottom edges; a first guide track positioned on one of the top and bottom edges; a second and third guide track positioned on the parallel sides of the frame, respectively; a flexible and bendable rear plate which is movably and slidably mounted on the second and third guide tracks; the second and third guide tracks having terminal ends which terminate a distance prior to one of the top and bottom edges so that the flexible rear plate is bendable and removable between the terminal ends of the second and third guide tracks and one of the top and bottom edges of the frame; and at least one support for holding displayed articles in front of the rear plate so that the rear plate is removable from the frame without disturbing the display articles, the support being unattached to the rear plate.

4 Claims, 1 Drawing Sheet

DISPLAY FRAME FOR SMALL ARTICLES

The present invention is related to a display frame for the exposure of small articles, according to the preamble of the claims.

In today's society the consumer is surrounded by thousands of signals of different kinds. A merchant desiring to compete with this attention, has to direct his message to the human feelings to stimulate the desire to buy. This is a fact for millions of people around the world being involved with marketing and sale.

How is it possible to transmit to the customer the feelings connected with a product to be sold? The colour is one of the strongest visual signals influencing our association ability. We connect for example Christmas with red colour, Easter with yellow and absolutely not the summer with grey.

Many groups of persons need an exposure which is correct according to the season and the time. With small products such as fashion accessories and esthetic small articles, a background colour corresponding to the colour of the season will be an important mean to emphasize the actuality of the product.

By displaying articles effort is made to present these in a best possible way and to the largest extent possible to adjust to the trends within the specific trade as to presentation, such as following the changes connected with the season for display, also in connection with using of colours generally.

It is one of a salesman's functions to attract the attention of the consumer and by means of the exposure of the articles to stimulate the desire to buy. Colours greatly are used to attract customers. On the other side many large groups of articles exist which always have to adjust to the fashion contacted exposure expression of the specific season or period. This means that for small articles especially, such as fashion accessories and esthetical small articles, the correct background colour of the season is an important means to expose no only the product but also its actuality.

Small articles in this meaning of the word normally are displaced in large amounts by hanging them from hooks, rails or shelves. Certainly each product in this connection also claims its own attraction when being displayed. It therefore is desired relatively quickly to be able to adjust to fashion changes, such as changing the colour of the background for the displayed articles or to change the colour because this will establish the impression that something new continuously is happening at the exhibition. The systems as used today are designed in such a way that one person needs at least one week to take down and hang up again in front of another background, all displayed articles in an average jewellery shop.

With the display frame according to the present invention, however, such a change of the background may be a matter of hours at the most. This is achieved with the display frame according to the invention as described by the features stated in the claims.

Figure 1:
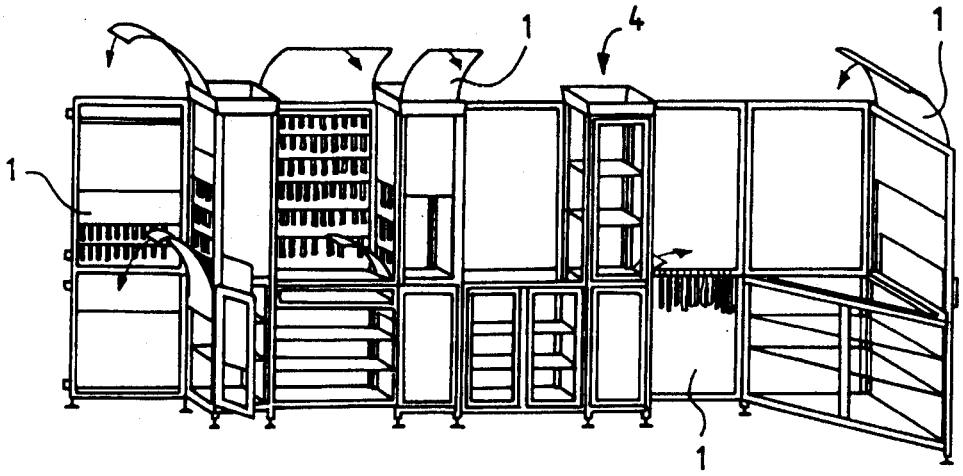
Figure 2:
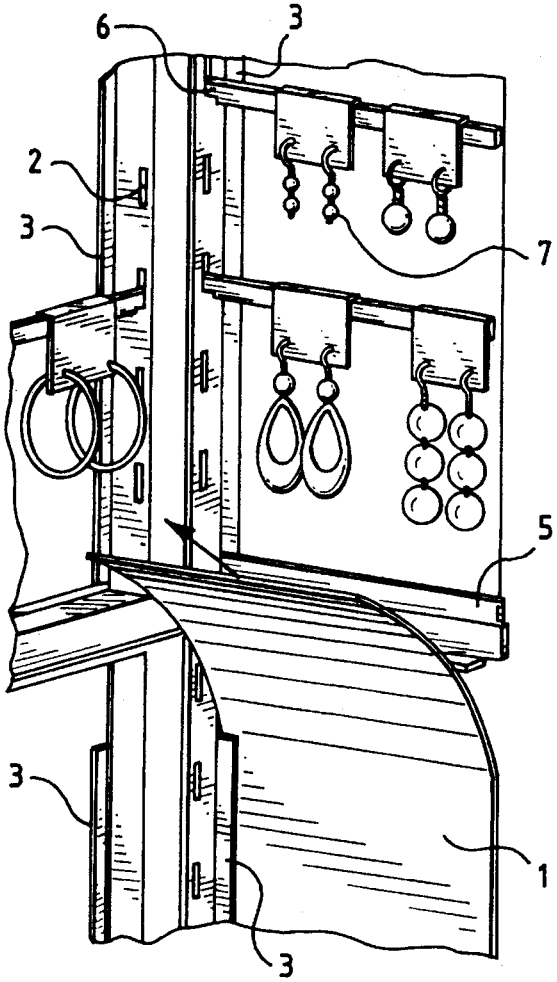

In the drawing FIG. 1 discloses schematically a fair stand comprising a number of interconnected display frames according to the present invention, FIG. 2 discloses a detail in perspective of an assembly of several display frames according to the present invention, such as for a cupboard or box type structure or an angled wall section, exposing jewellery in front of a wall the character of which may be selected for the special purpose and even exchanged, if desired.

FIG. 1 discloses an example of display show cases and display walls assembled by the display frame according to the present invention. The show case wall may consist of planes and boxes combined with each other to suit the specific location and assignment. Such display walls provide a possibility of hanging up articles for display, such as jewelers and smaller products, in front of a rear wall or rear plate 1, emphasizing the articles to be displaced.

The display frame according to the present invention may be used as pure frames such as disclosed in FIG. 1, however also being interconnected to a three dimensional figure in the room corresponding to a cupboard or a box 4 as disclosed in FIG. 1. The boxes may comprise three or four display frames for exposure of the articles in front of corresponding faces or plates.

A change of the rear plates or the rear walls in a traditional exhibition stand corresponding to what is disclosed in FIG. 1, would involve a substantial amount of work, taking down the displayed articles, changing the plates in the back walls and thereafter hanging up all articles in correct place.

With he display frame according to the present invention such a change of the background colour or the character of the background generally, may be carried out in a very short time, simply by changing the backplates 1 without moving the exposed articles.

As disclosed especially in FIG. 2, the display frame according to the present invention comprises in the rear edge guidings or tracks 3 in parallel vertical sides as well as a guiding or track 5 in one side perpendicular thereto, most convenient the lowermost horizontal side. The guidings may be rails secured to the frame profiles or tracks provided in the frame profiles. In a distance from and in front of the tracks 3 devices 6 for hanging up subjects, are secured to the frame profiles, such as holes, hooks or such, for hanging up articles 7 to be exposed, such as disclosed with the holes 2 and hanging devices 6, the articles or jewellery. The securement for the hanging devices 6 may be slots or holes 2 with a suitable shape.

The rear plate is guided and supported by the guidings, e.g. the tracks 3 and the track 5 which may be vertical tracks or horizontal lower track 5 respectively.

The tracks 3 terminate a distance below the stock divider in such a way that there is room enough to bend the rear plate 1 outwardly or inwardly, thereby to pull the plate out or push it in. The two parallel tracks 3 also may be arranged horizontally in such a way that the rear plate 1 may be pulled horizontally into the tracks, or they may be arranged vertically, depending of the arrangement of the frames in the exhibition.

The rear plate 1 is flexible in the sense that the plate may be bent outwardly to be pulled out of the track 3 and for example replaced by a new rear plate. This feature makes it possible to replace plates 1 in rack comprising several stocks with frames above each other, the plate 1 thereby being bent to go free of the frame above by pulling the plate out and pushing it in again. It also is possible to pull the plates out downwardly from the upper frame and upwardly from the lower frame by arranging the ending of vertical guidings correspondingly.

The display frames according to the present invention may be arranged such that they establish boxes, cupboards, show cases or plane walls as disclosed in FIG. 1. The frames also may be arranged in several stocks above each other and still allowing for changing the rear plates if desired.

The holes 2 for hanging the exposed articles up, may be used to arrange rods, shelves, hooks, jacks etc. depending on the desires and the articles to be displayed. Frames comprising holes and rear plates also may be used to establish the entire installation in shop, wall systems, counters, window exhibitions, fairs, sale kiosks etc.

Because the holes 2 are arranged at a distance in front of the rails 3 and thereby also the rear plate 1, the displayed articles suspending from hooks in the holes give a depth feeling which may further increased by suitable lightening between the article and the plate. Hereby the article is emphasized whereby the colour and the character of the plate give the desired atmosphere.

We claim:

1. A display frame for the display of small articles and having an interchangeable rear wall, said display frame comprising:

a frame which includes two parallel sides and top and bottom edges;

a first guide track positioned on one of said top and bottom edges;

a second and third guide track positioned on said two parallel sides of said frame, respectively;

a flexible and bendable rear plate which is movably and slidably mounted in said second and third guide tracks;

said second and third guide tracks having terminal ends which terminate a distance prior to one of said top and bottom edges so that said flexible rear plate is bendable and removable between said terminal ends of said second and third guide tracks and said one of said top and bottom edges of said frame;

means for holding displayed articles in front of said rear plate so that said rear plate is removable from said frame without disturbing said displayed articles, said holding means not being attached to said rear plate.

2. The display frame according to claim 1 in which said rear plate is continuously bendable.

3. The display frame of claim 1 in which said rear plate is bendable stepwise transversely to a longitudinal direction of said rear plate.

4. The display frame of claim 1 in which said second and third guide tracks are arranged vertically and said first guide track is arranged perpendicularly thereto and horizontally in a lowermost area, said terminal ends of said second and third guide tracks terminating a distance from said first guide track to allow said rear plate to be bent out of said frame between said first guide track and said terminal ends.

* * * * *